US007315702B2

(12) United States Patent
Takayanagi

(10) Patent No.: US 7,315,702 B2
(45) Date of Patent: Jan. 1, 2008

(54) IMAGE FORMING APPARATUS CAPABLE OF REDUCING TIME UNABLE TO PERFORM IMAGE FORMATION DUE TO TEMPERATURE CHANGE OF IMAGE BEARING MEMBER

(75) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 245 days.

(21) Appl. No.: 11/113,245

(22) Filed: Apr. 25, 2005

(65) Prior Publication Data

US 2005/0238373 A1 Oct. 27, 2005

(30) Foreign Application Priority Data

Apr. 27, 2004 (JP) ..... 2004-131237

(51) Int. Cl.
*G03G 15/00* (2006.01)

(52) U.S. Cl. ..... 399/44; 399/307

(58) Field of Classification Search ..... 399/38, 399/44, 297, 302, 307, 308
See application file for complete search history.

(56) References Cited

U.S. PATENT DOCUMENTS

| | | | | |
|---|---|---|---|---|
| 5,019,862 | A | 5/1991 | Nakamura et al. | 355/208 |
| 6,526,250 | B1 * | 2/2003 | Usui et al. | 399/307 |
| 6,577,836 | B2 * | 6/2003 | Yamashita et al. | 399/307 |
| 6,577,837 | B2 * | 6/2003 | Iida et al. | 399/307 |
| 6,842,600 | B2 | 1/2005 | Takayanagi | 399/296 |
| 7,062,208 | B2 | 6/2006 | Takayanagi | 399/296 |

FOREIGN PATENT DOCUMENTS

| | | |
|---|---|---|
| JP | 5-289458 | 11/1993 |
| JP | 7-49622 | 2/1995 |
| JP | 11-72993 | 3/1999 |

(Continued)

OTHER PUBLICATIONS

Patent Abstracts of Japan, Publication No. 05289458, Nov. 5, 1993.

(Continued)

*Primary Examiner*—Hoan Tran
(74) *Attorney, Agent, or Firm*—Fitzpatrick, Cella, Harper & Scinto

(57) ABSTRACT

An image forming apparatus is capable of reducing the time when it is unable to perform image formation due to a temperature change of an image bearing member. The apparatus includes a rotatable image bearing member; an electrostatic image forming device for continuously forming electrostatic images on the image bearing member based on forming image amount information; a toner image forming device for developing the electrostatic image and forming a toner image; a primary transferring device for transferring the toner image on the image bearing member to a rotatable intermediate transferring member; a simultaneously transferring and fixing device for transferring the toner image on the intermediate transferring member to a recording material and heating and fixing it; a detector detects a temperature of the image bearing member; and a starting device starts the electrostatic image forming means based on a detection result and the forming image amount information.

6 Claims, 8 Drawing Sheets

FOREIGN PATENT DOCUMENTS

| | | |
|---|---|---|
| JP | 11-73055 | 3/1999 |
| JP | 2000-75681 | 3/2000 |
| JP | 2000-352882 | 12/2000 |
| JP | 2001-318542 | 11/2001 |
| JP | 2001-356616 | 12/2001 |
| JP | 2002-24450 | 1/2002 |
| JP | 2004-33791 | 11/2004 |

OTHER PUBLICATIONS

Patent Abstracts of Japan, Publication No. 07049622, Feb. 21, 1995.
Patent Abstracts of Japan, Publication No. 11072993, Mar. 16, 1999.
Patent Abstracts of Japan, Publication No. 2000075681, Mar. 14, 2000.
Patent Abstracts of Japan, Publication No. 2001318542, Nov. 16, 2001.

* cited by examiner

IMAGE FORMING APPARATUS CAPABLE OF REDUCING TIME UNABLE TO PERFORM IMAGE FORMATION DUE TO TEMPERATURE CHANGE OF IMAGE BEARING MEMBER

BACKGROUND OF THE INVENTION

1. Field of the Invention

The present invention relates to an image forming apparatus including so-called simultaneously transferring and fixing means for primarily transferring a toner image on an image bearing member to an intermediate transferring member to transfer the toner image on the intermediate transferring member to a recording material and heating and fixing it on the recording material at the same time, and in particular, to the image forming apparatus capable of reducing the time unable to perform image formation due to a temperature change of the image bearing member.

2. Related Background Art

In recent years, an electrophotographic image forming apparatus is increasingly required to be miniaturized. Here, attention is directed, as effective means for miniaturization of the image forming apparatus, toward use of a so-called simultaneously transferring and fixing means having fixing means for fixing a toner image on a recording material integrated with secondary transferring means for transferring the toner image on an intermediate transferring member to the recording material.

As for the image forming apparatus using the simultaneously transferring and fixing means, an image bearing member receives heat from an intermediate transferring belt heated on fixing simultaneous with transfer during image formation so that temperature of the image bearing member changes. And there is a possibility that characteristics of the image bearing member change due to the change in temperature of the image bearing member so as not to form a good electrostatic image.

For that reason, means for detecting the temperature of the image bearing member is provided, and electrostatic image formation to the image bearing member is not performed in the case where the temperature of the image bearing member is out of a range of temperature capable of forming the electrostatic image. And if the temperature of the image bearing member gets into the range of temperature capable of forming the electrostatic image, the electrostatic image formation to the image bearing member is started.

However, there arose a problem that productivity of the image forming apparatus is reduced because the image formation is not performed until the temperature of the image bearing member gets into the range of temperature capable of forming the electrostatic image.

SUMMARY OF THE INVENTION

Thus, an object of the present invention is to provide an image forming apparatus using simultaneously transferring and fixing means and capable of reducing the time unable to perform image formation due to a temperature change of the image bearing member.

Another object is to provide the image forming apparatus including:

a rotatable image bearing member;

electrostatic image forming means capable of continuously forming electrostatic images on the image bearing member based on forming image amount information;

toner image forming means for developing the electrostatic image on the image bearing member and forming a toner image;

primary transferring means for transferring the toner image on the image bearing member to a rotatable intermediate transferring member;

the simultaneously transferring and fixing means for simultaneously transferring the toner image on the intermediate transferring member to a recording material and heating and fixing the toner image to the recording material;

image bearing member detecting means for detecting temperature of the image bearing member; and starting means for starting electrostatic image formation of the electrostatic image forming means based on a detection result of the image bearing member detecting means and the forming image amount information.

DESCRIPTION OF THE PREFERRED EMBODIMENTS

The present invention solved the problem by starting formation of an electrostatic latent image to a photosensitive drum 1 (image bearing member) based on a detection result of temperature of the photosensitive drum 1 and an amount of images formed.

Here, an amount of change of temperature of the photosensitive drum 1 during image formation is different according to the amount of images formed. To be more specific, in the case where the amount of images formed after stopping the formation of an electrostatic image is the amount for significantly changing the temperature of the photosensitive drum 1, the formation of an electrostatic image is not started until the temperature of the photosensitive drum becomes significantly different from temperature at which formation of a good electrostatic image is difficult.

Inversely, in the case where the amount of images formed after stopping the formation of an electrostatic image is not the amount for significantly changing the temperature of the photosensitive drum 1, the formation of an electrostatic image is started before the temperature of the photosensitive drum 1 becomes significantly different from temperature at which formation of a good electrostatic image is difficult.

To be more specific, in the case where the amount of images formed is not the amount for significantly changing the temperature of the photosensitive drum 1, time for stopping the image formation from stopping the formation of an electrostatic image until restarting it becomes short.

Thus, it became possible to reduce the time for interrupting the image formation due to the change of temperature of the photosensitive drum 1. Hereunder, details of embodiments of the present invention will be described.

First Embodiment (1) Example of an image forming apparatus

Figure 1:
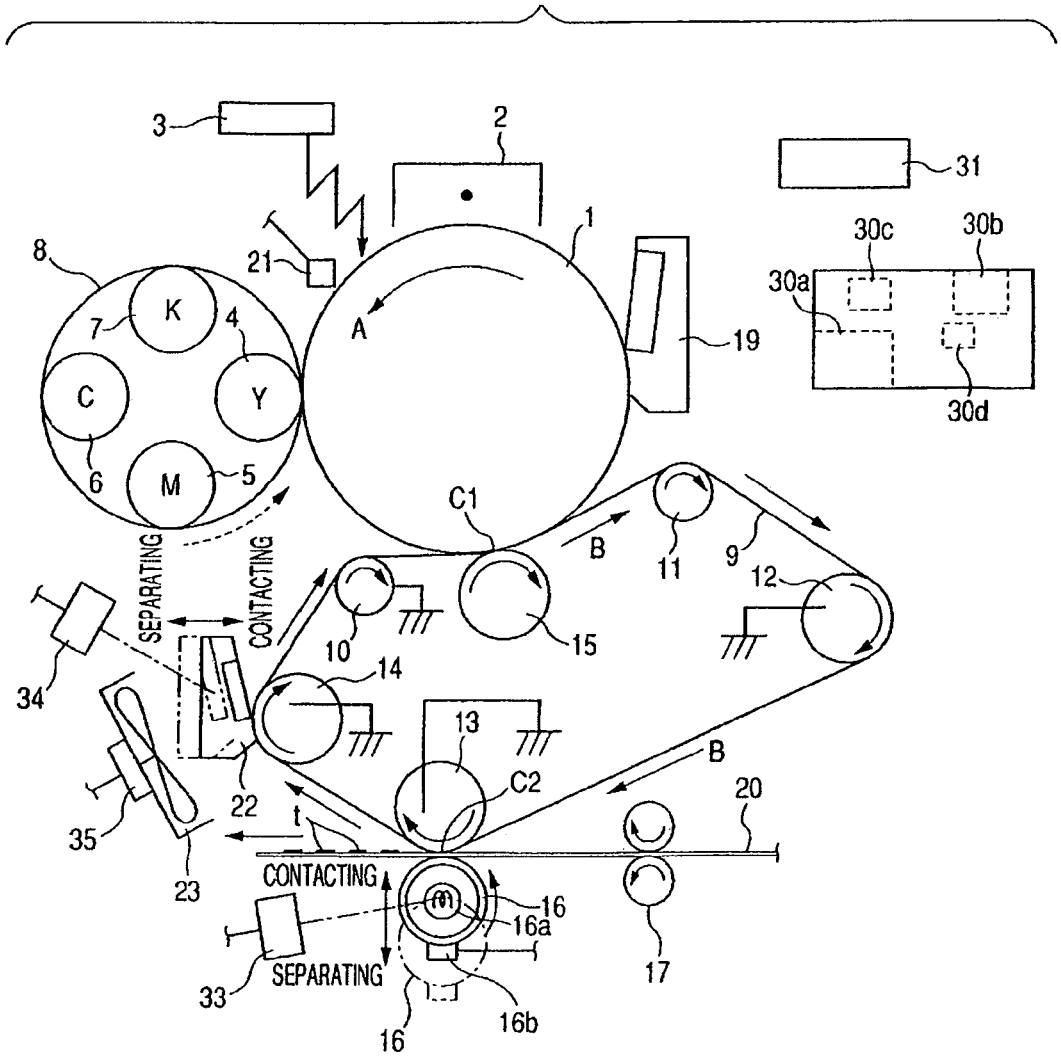
FIG. 1 is a general configuration model diagram of an image forming apparatus of a first embodiment.
Figure 2:
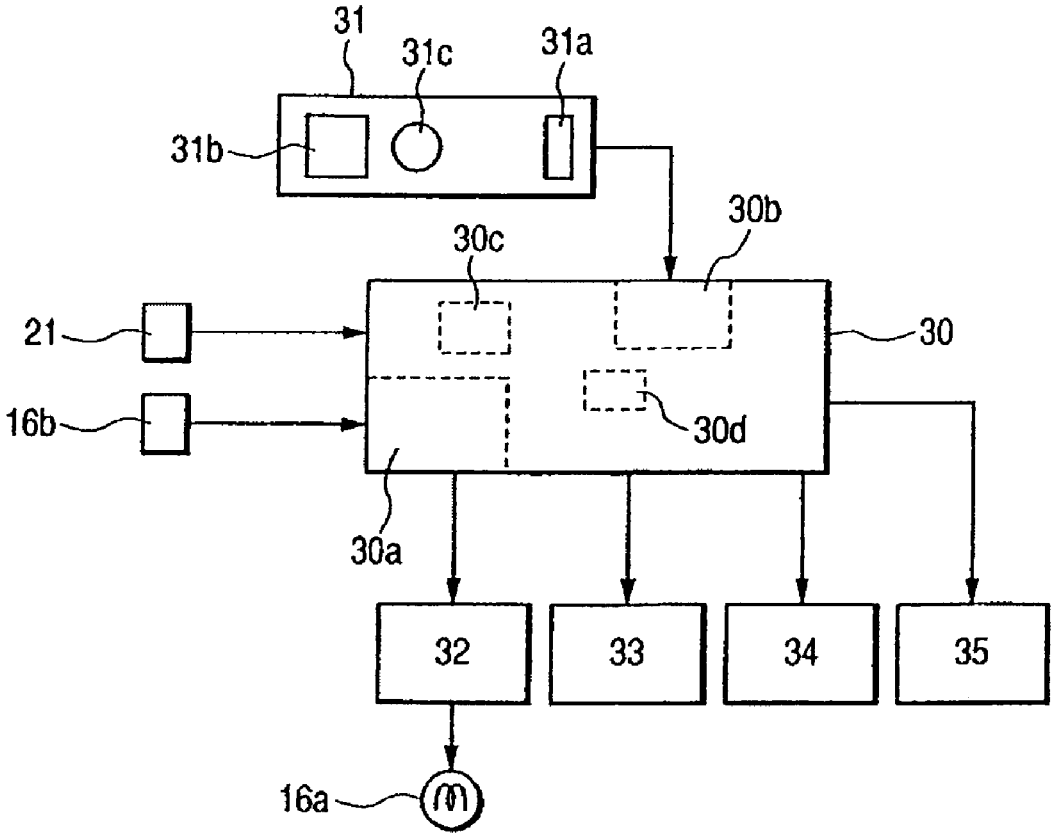
FIG. 2 is a block diagram of a control system.

FIG. 1 is a general configuration model diagram of an electrophotographic color image forming apparatus using an intermediate transferring member and transfer fixing means of this embodiment. FIG. 2 is a block diagram of a control system.

Reference numeral 1 denotes an electrophotographic photosensitive drum (image bearing member) as a first image bearing member which is rotatively driven at a predetermined peripheral velocity in a counterclockwise direction as indicated by an arrow A. And on its surface, the electrostatic latent image according to image information is formed along with its rotation by a known electrophotographic process device such as a charging apparatus 2, an exposure apparatus (electrostatic image forming means) 3 for performing exposure based on the image information. And the electrostatic latent images are continuously formed based on the amount of images formed.

Reference numeral 8 denotes a developing device unit of a rotary switching method, which has four developing devices 4 to 7 corresponding to colors of yellow (Y), magenta (M), cyan (C) and black (K) so as to develop the electrostatic latent image formed on the photosensitive drum 1 with one of the developing devices (toner image forming means) 4 to 7 and thereby form a toner image.

The image forming apparatus of the present embodiment has the photosensitive drum 1 configured by a material charging negative polarity, and development is performed by an inversion development method. Therefore, all the toners to be used are the types charging the negative polarity.

Reference numeral 9 denotes an intermediate transferring belt as an intermediate transferring member, which is looped around on a plurality of loop-around rollers 10 to 14 to form a primary transfer portion (primary transfer nip portion) C1 abutting the surface of the photosensitive drum 1. The intermediate transferring belt 9 is rotatively driven at approximately the same peripheral velocity as the photosensitive drum 1 in a clockwise direction as indicated by an arrow B which is forward to a moving direction of a photosensitive drum surface in the primary transfer portion C1.

The image forming apparatus of the present embodiment has the loop-around rollers 10 and 11 placed in proximity to a position of the primary transfer portion C1. The loop-around roller 12 as a metallic driven-roller used to form a flat primary transfer surface of the intermediate transferring belt 9 is a tension roller for constantly controlling a tension of the intermediate transferring belt 9, the loop-around roller 14 is a driving roller of the intermediate transferring belt 9, and the loop-around roller 13 is a backup roller for transfer fixing. The loop-around rollers 10 to 14 are grounded. The material used for the intermediate transferring belt 9 is a resin such as polyimide, polycarbonate, polyester, polypropylene, polyethylene terephthalate, acryl or vinyl chloride or various kinds of rubber including an appropriate amount of carbon black as an antistatic agent, which has volume resistivity of 1E+8 to 1E+13(Ω·cm) and thickness of 0.07 to 0.1 (mm).

Reference numeral 15 denotes primary transfer rollers as primary transferring means, which are arranged on a backside of the intermediate transferring belt on the opposite side to the photosensitive drum 1 side of the intermediate transferring belt 9 in the primary transfer portion C1 opposed to the photosensitive drum 1 of the intermediate transferring belt 9 to be crimped on the photosensitive drum 1 via the intermediate transferring belt 9. The primary transfer rollers 15 have a primary transfer bias of straight polarity as reverse polarity to charge polarity of the toner applied thereto by an unshown bias application power supply so that the toner image on the photosensitive drum 1 is primarily transferred onto the intermediate transferring belt 9.

Reference numeral 16 denotes a pressure heat roller (heating member) comprising the transfer fixing means, which is arranged separably from the loop-around roller 13 by rocking means 33 via the intermediate transferring belt 9 with the loop-around roller 13 out of the intermediate transferring belt loop-around rollers 10 to 14 as the backup roller for transfer fixing. The transfer fixing means is comprised of the heat roller 16 and the backup roller 13. The heat roller 16 is put in a crimped state against the backup roller 13 via the intermediate transferring belt 9 so that a transfer fixing portion (secondary fixing simultaneous with transfer nip portion) C2 is formed between the heat roller 16 and the intermediate transferring belt 9. The heat roller 16 is driven and rotated by rotation of the intermediate transferring belt 9. The heat roller 16 includes a heater 16*a* , where electric power is supplied to the heater 16*a* from a heater power supply 32 (FIG. 2) and the heater 16*a* generates heat so as to have the heat roller 16 internally heated. And surface temperature of the heat roller 16 is detected by a temperature sensor 16*b* so that its electrically detected temperature information is inputted to a temperature control function portion 30*a* of a control circuit portion 30 as control means. The temperature control function portion 30*a* controls supplied power from the heater power supply 32 to the heater 16*a* to keep the electrically detected temperature information inputted from the temperature sensor 16*b* corresponding to a predetermined approximately constant fixing temperature so as to control the heat roller 16 at the predetermined fixing temperature.

Reference numeral 17 denotes a pair of resist rollers which once position and stop a transfer material 20 supplied from an unshown sheet feeding mechanism and then feed it into the transfer fixing portion C2 in predetermined control timing.

Reference numeral 19 denotes a drum cleaner for removing the toner remaining on the photosensitive drum 1 after the primary transfer.

Reference numeral 21 denotes a temperature sensor (image bearing member detecting means) for detecting the temperature of the photosensitive drum 1. The electrically detected temperature information on the photosensitive drum 1 of the temperature sensor 21 is inputted to the control circuit portion 30.

Reference numeral 22 denotes a belt cleaner for removing the toner remaining on the intermediate transferring belt 9 after the transfer fixing. The belt cleaner 22 is arranged to be separable by rocking means 34 from an outer surface of an intermediate transferring belt portion wound and put on the belt loop-around roller 14 as an intermediate transferring belt driving roller on a more downstream side in an intermediate transferring belt moving direction than the transfer fixing portion C2. As a cleaning element is put in a state of contacting the intermediate transferring belt 9, the belt cleaner 22 is put in a state of removing the toner remaining on the intermediate transferring belt 9.

In the case of forming a color image in multiple colors, the control circuit portion 30 controls the rocking means 33 and 34 and thereby keeps the pressure heat roller 16 and the belt cleaner 22 separate from the intermediate transferring belt 9 in a noncontact state until the toner image before a final color passes the positions of the pressure heat roller 16 and the belt cleaner 22.

Reference numeral 23 denotes a cooling fan as cooling means of the intermediate transferring belt 9 which is a second image bearing member. The cooling fan 23 is placed on a downstream side of the transfer fixing portion C2 and on an upstream side of the primary transfer portion C1 in a rotation direction of the intermediate transferring belt 9.

The control circuit portion 30 actuates the cooling fan 23 by turning on a fan motor 35 when a main power switch 31*a* of the image forming apparatus is turned on, and stops the cooling fan 23 by turning off the fan motor 35 when the main power switch 31*a* is turned off.

Reference numeral 31 denotes a console portion of the image forming apparatus. The console portion 31 has various image forming condition setting keys and control keys arranged thereon, such as the main power switch 31*a*, a number of times of continuous image formation setting portion (pagination setting means such as a numeric keypad) 31*b* and an image forming start key 31*c*.

Next, an image formation process will be described. First, the electrostatic latent image is written on the photosensitive drum 1, and is developed by the developing devices 4 to 7 corresponding to the-electrostatic latent image. For instance, if the electrostatic latent image written on the photosensitive drum 1 is corresponding to image information on yellow, the electrostatic latent image is developed by the developing device 4 including a yellow toner so that a yellow toner image is created on the photosensitive drum 1. And the toner image formed on the photosensitive drum 1 is transferred from the photosensitive drum 1 to the surface of the intermediate transferring belt 9 in the primary transfer portion C1 in which the photosensitive drum 1 and the intermediate transferring belt 9 are in contact. The toner remaining on the photosensitive drum 1 after the primary transfer is removed by the drum cleaner 19.

In the case where a monochromatic image formation mode is selected at this time, the toner image primarily transferred to the intermediate transferring belt 9 is immediately transferred and fixed on the transfer material 20 by the transfer fixing portion C2. In the case where a color image formation mode having the toner images in multiple colors superimposed is selected, the processes of toner image formation on the photosensitive drum 1 and the primarily transfer of the toner image are repeated by the number of colors. For instance, in the case of forming a full-color image having the toner images in four colors superimposed, the toner images in yellow, magenta, cyan and black are formed on the photosensitive drum 1 at each rotation thereof. These toner images are primarily transferred in series to the intermediate transferring belt 9. The intermediate transferring belt 9 rotates in the same cycle as the photosensitive drum 1 while supporting the toner images primarily transferred first. And the intermediate transferring belt 9 has the toner images in magenta, cyan and black transferred thereon at each rotation thereof. During this time, the heat roller 16 and the belt cleaner 22 of the transfer fixing means are kept separate from the intermediate transferring belt 9 in a noncontact state so as not to disrupt the toner images.

The toner images thus primarily transferred to the intermediate transferring belt 9 are conveyed to the transfer fixing portion C2 along with the rotation of the intermediate transferring belt 9. As for the heat roller 16 and the belt cleaner 22 of the transfer fixing means, the rocking means 33 and 34 are controlled by the control circuit portion 30 in timing in which the toner image in the final color is primarily transferred on the intermediate transferring belt 9 and an end of the toner image gets close to the transfer fixing portion C2 as predetermined so as to be switched to a state of contacting the intermediate transferring belt 9 respectively.

The transfer material 20 fed from a sheet feeding mechanism portion is supplied to the transfer fixing portion C2 by the resist rollers 17 in predetermined timing, and is sandwiched against the backup roller 13 by the pressure heat roller 16. To be more specific, the transfer fixing portion C2 performs a melting transfer fixing process wherein the toner is pressurized from the backside of the transfer material and the surface of the toner image by the backup roller 13 and the heated pressure heat roller 16 and the toner is thereby plastically deformed, sintered and coalesced and seeps in the transfer material 20 to be cooled and firmly fixed immediately after passage so as to simultaneously transfer and fix a toner image t onto the transfer material. After passing the transfer fixing portion C2, the intermediate transferring belt 9 has its image bearing surface side cleaned by the belt cleaner 22.

The intermediate transferring member is not limited to a belt type as an intermediate transferring member, but may also be a drum type.

(2) Cooling process configuration of the photosensitive drum 1

The present embodiment adopted the following configuration as a photosensitive drum cooling process configuration for eliminating the aforementioned problem of the image forming apparatus using the intermediate transferring member 9 and transfer fixing means 13 and 16 described above, that is, a harmful effect of the photosensitive drum 1 as the image bearing member due to a temperature rise exceeding allowance of the photosensitive drum 1 in conjunction with progress of continuous image formation.

To be more specific, the control circuit portion 30 as control means should comprise a memory function portion 30*b* as storage means for storing an image formation start signal having information on the number of times of continuous image formation (JOB number) and the remaining number of times of continuous image formation out of the number of times of continuous image formation as a result of the signal. And the control circuit portion 30 compares the number of times of continuous image formation or the remaining number of times of continuous image formation to a limited number of times of continuous image formation prescribed in advance. In the case of performing the image formation over the limited number of times of continuous image formation, the control circuit portion 30 suspends the toner image formation on the photosensitive drum 1 and the transfer fixing of the toner image to transfer material 20, that is, suspends heating of the heat roller 16 and performs an idle rotation mode for rotating the photosensitive drum 1 and the intermediate transferring member 9 together during a prescribed cooling time each time the continuous image formation according to the limited number of times of continuous image formation is finished. It is also possible, during the idle rotation mode, to rotate only the photosensitive drum 1 and stop the intermediate transferring member 9.

If the number of times of continuous image formation setting portion 31*b* of the console portion 31 of the image forming apparatus is operated to set a desired number of times of continuous image formation and set other necessary image forming conditions and the image forming start key 31*c* is pushed, a image formation start signal having information on the number of times of continuous image formation is stored in the memory function portion 30*b* as the storage means, and the remaining number of times of continuous image formation out of the number of times of continuous image formation is also stored therein as a result of the signal.

In short, a limit is set to the number of times of continuously forming the images, and the prescribed cooling time is given after finishing a job of the continuous image formation to idly rotate the photosensitive drum 1 as the image bearing member and the intermediate transferring member 9 and thereby radiate heat of them so as to prevent excessive thermal storage of the photosensitive drum 1. It is thereby possible to render the cooling process of the photosensitive drum 1 effective without rendering the apparatus larger.

Figure 3:
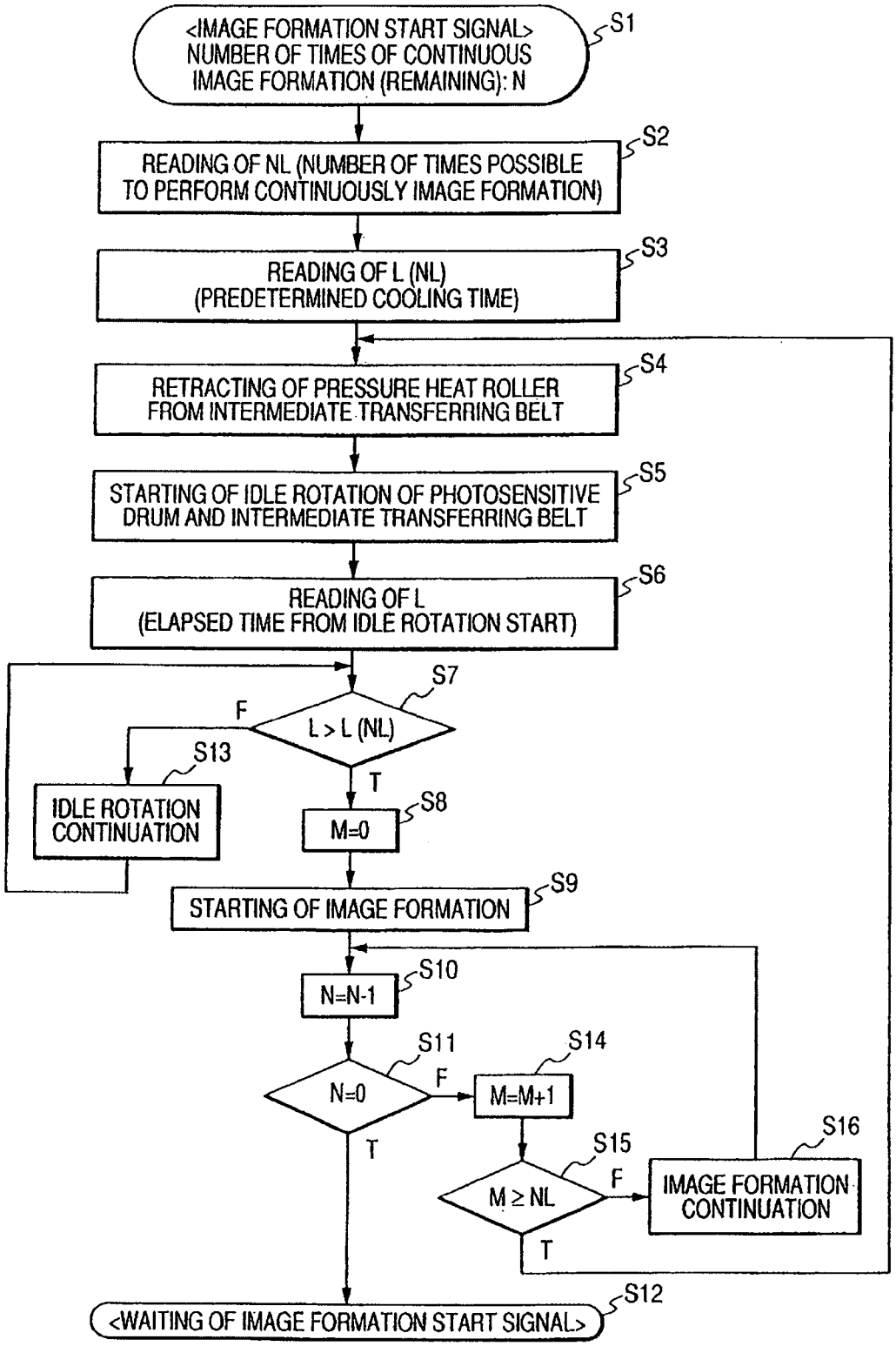
FIG. 3 is a flow diagram of control operation performed by a control circuit portion in a photosensitive drum cooling process configuration.

FIG. 3 is a flow diagram of control operation performed by the control circuit portion 30 in the photosensitive drum cooling process configuration.

As shown in FIG. 3, this embodiment receives the image formation start signal having the information on the remaining number of times of continuous image formation N and then reads the number of times of continuous image formation NL (steps S1→S2). Once it reads the number of times of continuous image formation NL, it reads the prescribed cooling time L (NL) according to that NL (steps S2→S3).

Next, the pressure heat roller 16 is separated from the intermediate transferring belt 9 to start the idle rotation of the photosensitive drum and intermediate transferring belt, and the idle rotation is continued until idle rotation time thereof becomes L (NL) (steps S4→S5→S6→S7→S13→S7).

Next, the continuous image formation is started, and the image formation is continued until the number of times of image formation becomes NL (steps S8→S9→S10→S11→S14→S15→S16→S10).

During the continuous image formation, the remaining number of times of continuous image formation N read in the step S1 is counted down one by one(step S10), and goes into a standby state for the image formation start signal when N becomes zero (steps S11→S12).

If N does not become zero and the number of times of continuous image formation reaches NL, the pressure heat roller 16 is separated from the intermediate transferring belt 9 again (steps S11→S14→S15→S4), and the idle rotation of the photosensitive drum and intermediate transferring belt is started and continued until idle rotation time L thereof becomes L (NL) (steps S5→S6→S7→S13→S7).

The continuous image formation is started again and continued until the number of times of image formation thereof becomes NL (steps S8→S9→S10→S11→S14→S15→S16→S10). During the continuous image formation, the remaining number of times of continuous image formation N read in the step S1 is counted down one by one, and goes into a standby state for the image formation start signal when N becomes zero (steps S10→S11→S12).

Second Embodiment

The present embodiment adopted the following configuration as the photosensitive drum cooling process configuration of the image forming apparatus (FIG. 1) using the intermediate transferring belt 9 and transfer fixing means 13 and 16.

To be more specific, the control circuit portion 30 as control means should comprise a memory function portion 30*b* as storage means for storing the image formation start signal having information on the number of times of continuous image formation and the remaining number of times of continuous image formation out of the number of times of continuous image formation as a result of the signal. And the control circuit portion 30 should also comprise the temperature sensor 21 as the image bearing member detecting means for detecting the temperature of the photosensitive drum 1 as the first image bearing member. The control circuit portion 30 as the control means has as control modes: the idle rotation mode for suspending the toner image formation on the photosensitive drum 1 and the transfer fixing of the toner image from the intermediate transferring belt 9 to transfer material and rotating the photosensitive drum 1 and the intermediate transferring belt 9 together during the time from receiving the image formation start signal until receiving the next image formation start signal; and an image formation mode for performing the toner image formation on the photosensitive drum 1 and the transfer fixing of the toner image from the intermediate transferring belt 9 to transfer material. And the control circuit portion 30 switches between the idle rotation mode and the image formation mode according to a detection result of the temperature sensor 21 and the number of times of continuous image formation or the remaining number of times of continuous image formation.

And the control circuit portion 30 decides a specified temperature for cooling the photosensitive drum 1 in the middle of the continuous image formation according to the number of times of continuous image formation or the remaining number of times of continuous image formation, and switches between the idle rotation mode and the image formation mode according to a result of comparison between the decided specified temperature and the detection result of the temperature sensor 21.

According to the photosensitive drum cooling process configuration, in the case where the temperature of the photosensitive drum 1 rises on the continuous image formation and it requires cooling, it is possible to cool it just as required by the remaining number of times of continuous image formation so as to reduce printing time efficiently without a need of more than necessary cooling time for a user. To be more specific, it is possible to provide the image forming apparatus of improved productivity.

The heat roller 16 as the transfer fixing means is not in contact with the intermediate transferring belt during the idle rotation mode. To be more specific, it is possible to render the heat roller 16 as the transfer fixing means which is a heat source noncontact with the intermediate transferring belt 9 during the idle rotation mode and thereby further promote the cooling of the intermediate transferring belt 9 so as to reduce the time of the idle rotation mode and the printing time for the user. To be more specific, it is possible to provide the image forming apparatus of improved productivity.

Figure 4:
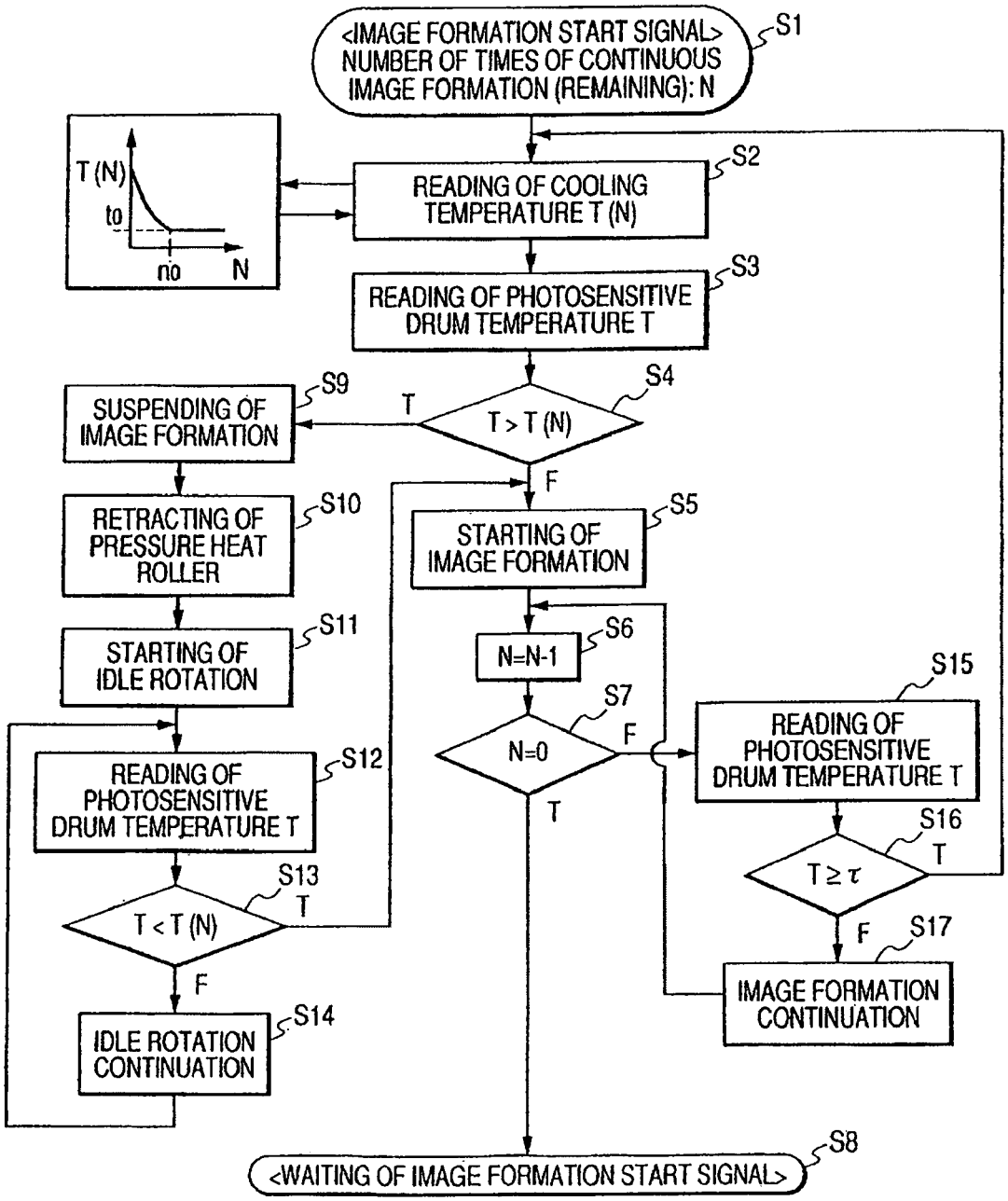
FIG. 4 is a flow diagram of control operation performed by a control circuit portion in the photosensitive drum cooling process configuration of a second embodiment.

FIG. 4 is a flow diagram of the control operation performed by the control circuit portion 30 in the photosensitive drum cooling process configuration of this embodiment.

As shown in FIG. 4, on receiving the image formation start signal having the information on the number of times of continuous image formation (remaining) N (image amount), this embodiment reads temperature data on photosensitive drum temperature (hereafter, referred to as cooling temperature T(N)) as should be performed in advance in the case of the number of times of continuous image formation (remaining) N (steps S1→S2).

Figure 5:
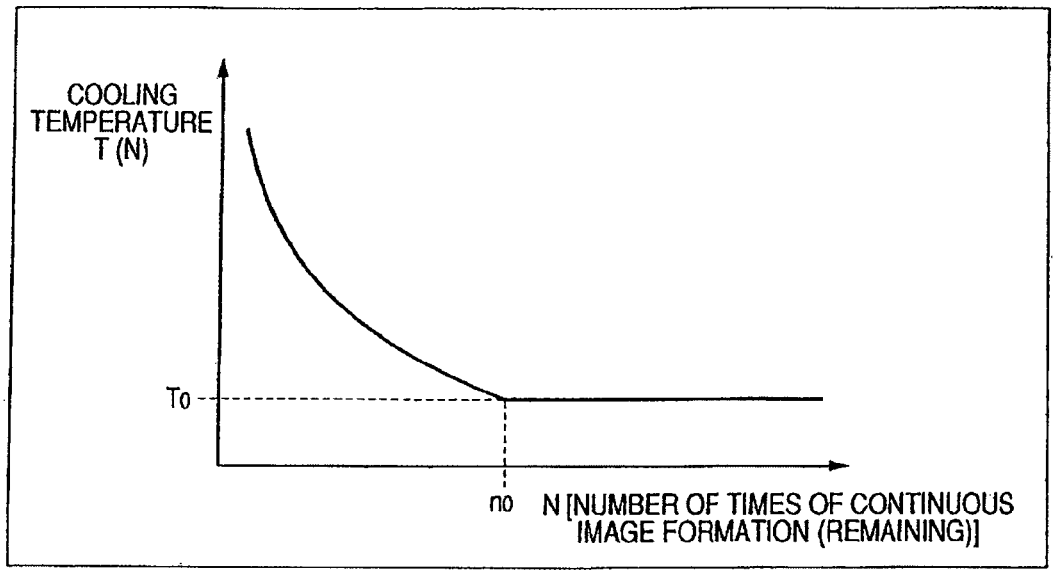
FIG. 5 is a diagram describing a relation between the remaining number of times of continuous image formation N and cooling temperature T (N)

The relation between the number of times of continuous image formation (remaining) N and the cooling temperature T(N) is acquired in advance. As shown in FIG. 5, in the case where the number of times of continuous image formation (remaining) N is an arbitrary threshold n0 or less, it means that, the smaller the number of times of continuous image formation (remaining) N is, the larger the cooling temperature T(N) becomes so that the photosensitive drum 1 does not need to be cooled so much. And if the number of times of continuous image formation (remaining) N is within this range, the temperature of the photosensitive drum 1 during the continuous image formation does not become the rise limit temperature τ or more.

In the case where the number of times of continuous image formation (remaining) N is larger than the threshold n0, the cooling temperature T(N) becomes constant. It means that the temperature of the photosensitive drum 1 does not become the rise limit temperature τ until the number of times of continuous image formation (remaining) N becomes the threshold n0 times. And it also means that the temperature of the photosensitive drum 1 becomes the rise limit temperature τ or more and the photosensitive drum 1 needs to be cooled in the middle in the case of n0 times or more.

In the graph of FIG. 5, the horizontal axis indicates a larger number of times as it goes rightward, and the vertical axis indicates a higher cooling temperature as it goes upward. A description will be given below as to the "cooling temperature T(N)" of the vertical axis or the "temperature data on photosensitive drum temperature as should be performed in advance in the case of the number of times of continuous image formation (remaining) N."

In the case where the temperature of the photosensitive drum rises, characteristics of the photosensitive drum change so that it becomes no longer possible to form a desired electrostatic latent image. To be more specific, it is possible, if the number of times of continuous image formation (remaining) N is small, to reduce a thermal storage amount to the amount no longer capable of forming the desired electrostatic latent image or less. And it is necessary, as the thermal storage amount becomes large if the number of times of continuous image formation (remaining) N is large, to regulate the number of times of continuous image formation (remaining) N to be the amount no longer capable of forming the desired electrostatic latent image or less. Thus, there should be a photosensitive drum temperature T at which it should be set on starting the image formation according to the number of times of continuous image formation (remaining) N. It is referred to as the "cooling temperature T(N)" which is acquired in advance in an experiment. FIG. . 5 shows it.

It is possible to directly compare the cooling temperature T(N) and the photosensitive drum temperature T measured by the temperature sensor 21 as to which is small or large (T>T(N), T<T(N)). As previously described, it is because the cooling temperature T(N) is the "photosensitive drum temperature" at which it should be set on starting the image formation. The cooling temperature T(N) may be high because the number of times of image formation is small. Formation of the desired electrostatic latent image. To be more specific, if the number of times of continuous image formation (remaining) is small, it is possible to reduce the thermal storage amount to the amount no longer capable of forming the desired electrostatic latent image or less. And it is necessary, as the thermal storage amount becomes large if the number of times of continuous image formation (remaining) N is large, to regulate the continuous image formation time to be the amount no longer capable of forming the desired electrostatic latent image or less.

In the case where the number of times of continuous image formation (remaining) N is larger than the threshold n0, the cooling temperature T(N) becomes constant. As it is considered that there is a limit to cooling of the photosensitive drum temperature, the cooling temperature T(N≧n0) should inevitably be constant in the case where the number of times of image formation (remaining) is too large (larger than the threshold n0).

Next, the temperature sensor 21 detects the photosensitive drum temperature T(step S3). In the case where the photosensitive drum temperature T is lower than the cooling temperature T(N), it starts the image formation, that is it goes into the image formation mode, and the image formation mode is continuously performed unless the photosensitive drum temperature T becomes the rise limit temperature τ or more (steps S4→S8, S7→S14→S15→S6).

In the case where the photosensitive drum temperature T is higher than the cooling temperature T(N) (T of the step S4), it suspends the image formation (step S9), it removes the pressure heat roller 16 to a position not in contact with the intermediate transferring belt 9 (step S10), goes into the idle rotation mode of the photosensitive drum 1 and intermediate transferring belt 9 (step S11), and cools the photosensitive drum 1 by means of natural radiation. The idle rotation mode is continued unless the photosensitive drum temperature T becomes lower than the cooling temperature T(N) (steps S12→S13→S14). The image formation is started when the photosensitive drum temperature T becomes lower than the cooling temperature T(N) (steps S13→S5). The image formation is continuously performed unless the photosensitive drum temperature T is the rise limit temperature T or more (steps S5 to S8, S7→S15 to S17→S6).

In the case where the number of times of continuous image formation (remaining) N in an early stage on receiving the image formation start signal is the threshold n0 or more, there is timing in which the photosensitive drum temperature T becomes the rise limit temperature τ or more if the image formation is continuously performed (T of the step S16). The number of times of continuous image formation (remaining) N at the time is stored, and the cooling temperature T(N) corresponding to the number of times of continuous image formation (remaining) N is read (steps S). Next, the photosensitive drum temperature T is read (steps S3). In this case, the photosensitive drum temperature T is naturally higher than the cooling temperature T(N) (T of the step S4), and so the image formation is suspended, the pressure heat roller 16 is removed to a position not in contact with the intermediate transferring belt 9, and the photosensitive drum 1 and intermediate transferring belt 9 go into the idle rotation mode so as to cool the photosensitive drum 1 by means of natural radiation (steps S9 to S11). The idle rotation mode is continued unless the photosensitive drum temperature T becomes lower than the cooling temperature T(N) (steps S12 to S14).

When the photosensitive drum temperature T becomes lower than the cooling temperature T(N), an image formation starting portion (starting means) 30*c* starts to form the electrostatic latent image by controlling exposure means 3 so as to restart the image formation (steps S5). To be more specific, the image formation starting portion 30*c* starts to form the electrostatic latent image by controlling the exposure means 3 based on the number of times of continuous image formation (remaining) N and the temperature of the photosensitive drum 1 measured by the temperature sensor 21 so as to restart the image formation. The image formation is continuously performed unless the photosensitive drum temperature T becomes the rise limit temperature X or more (steps S5 to S8, S7→S15 to S17), and in the case where the photosensitive drum temperature T becomes the rise limit temperature τ or more again (T of the step S16), an image formation stopping portion (stopping means) 30*d* stops forming the electrostatic latent image by controlling the exposure means 3. And the photosensitive drum temperature is cooled in the idle rotation mode (steps S4→S9 to S14) while repeating them until the number of times of continuous image formation (remaining) becomes zero (T of the step S7) to be in the standby state for the next image formation start signal (steps S8).

The photosensitive drum cooling process configuration of this embodiment is characterized in that, in the case where the photosensitive drum temperature T thus becomes the rise limit temperature τ or more during the continuous image formation, the temperature at which the photosensitive drum should be cooled is decided according to the number of times of continuous image formation (remaining), and the photosensitive drum is cooled in the idle rotation mode as required by the remaining image formation so as to efficiently reduce the time for the idle rotation mode. Even when the number of times of continuous image formation is large and the photosensitive drum needs to be cooled, each individual user can obtain outputted matters at the earliest.

Figure 6:
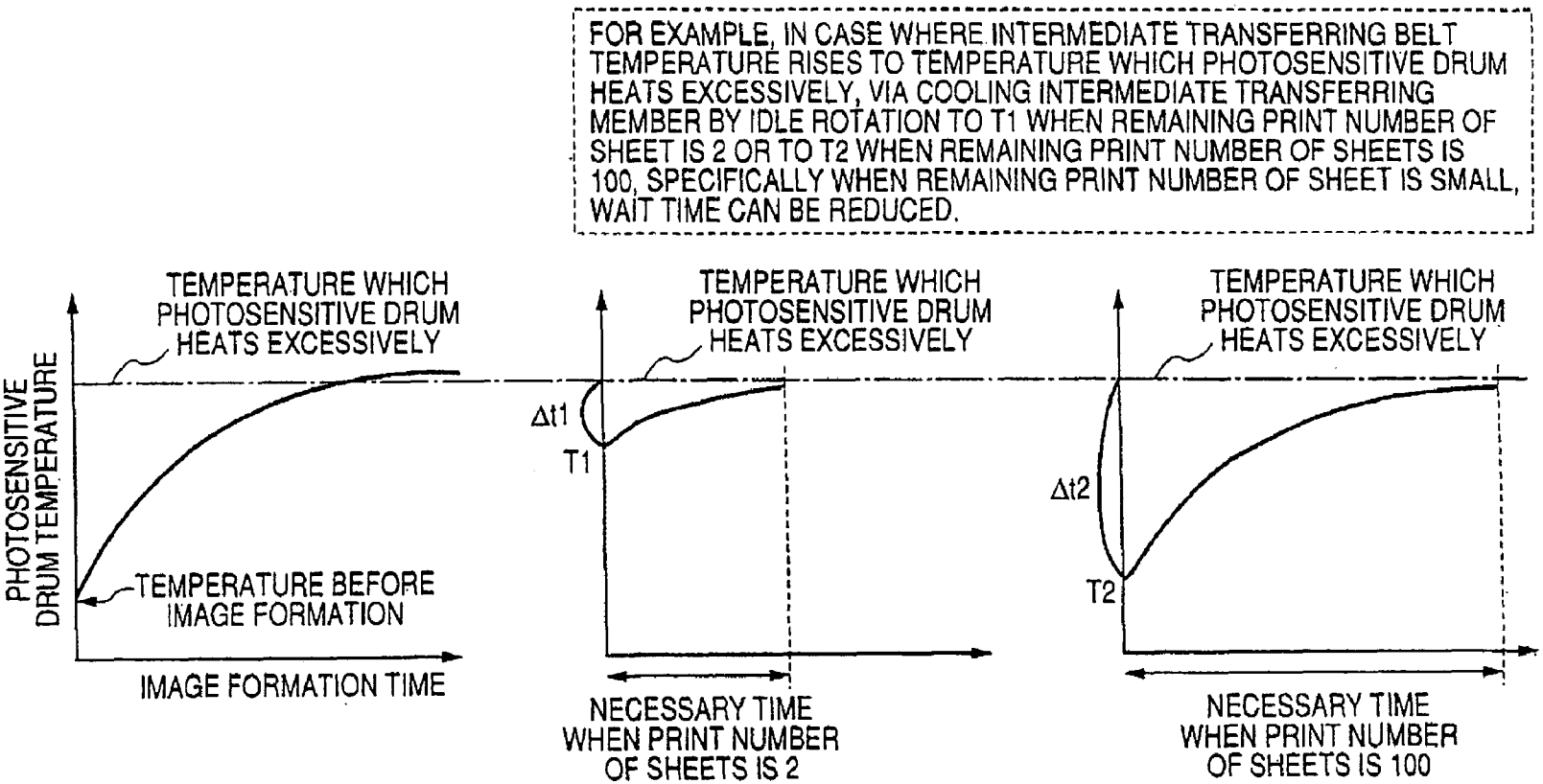
FIG. 6 is a diagram describing a characteristic of the photosensitive drum cooling process configuration of the second embodiment more concretely.

To describe this more concretely by using FIG. 6 and taking for instance the case where the intermediate transferring belt 9 reaches a temperature at which the temperature of the photosensitive drum 1 rises excessively, the idle rotation mode is performed until the photosensitive drum temperature is cooled down to the temperature of T1 equivalent to two pages if the number of the remaining print number of sheets is two and until the photosensitive drum temperature is cooled down to the temperature of T2 equivalent to a hundred pages if the number of the remaining print number of sheets is a hundred so as to restart the image formation. It is thereby possible to reduce waiting time especially in the case where the number of the remaining print number of sheets is small.

Third Embodiment

This embodiment has further incorporated a control operation for powering up the cooling fan 23 (FIG. 1) and a control operation for powering it down into the idle rotation mode of the photosensitive drum cooling process configuration of the second embodiment.

Figure 7:
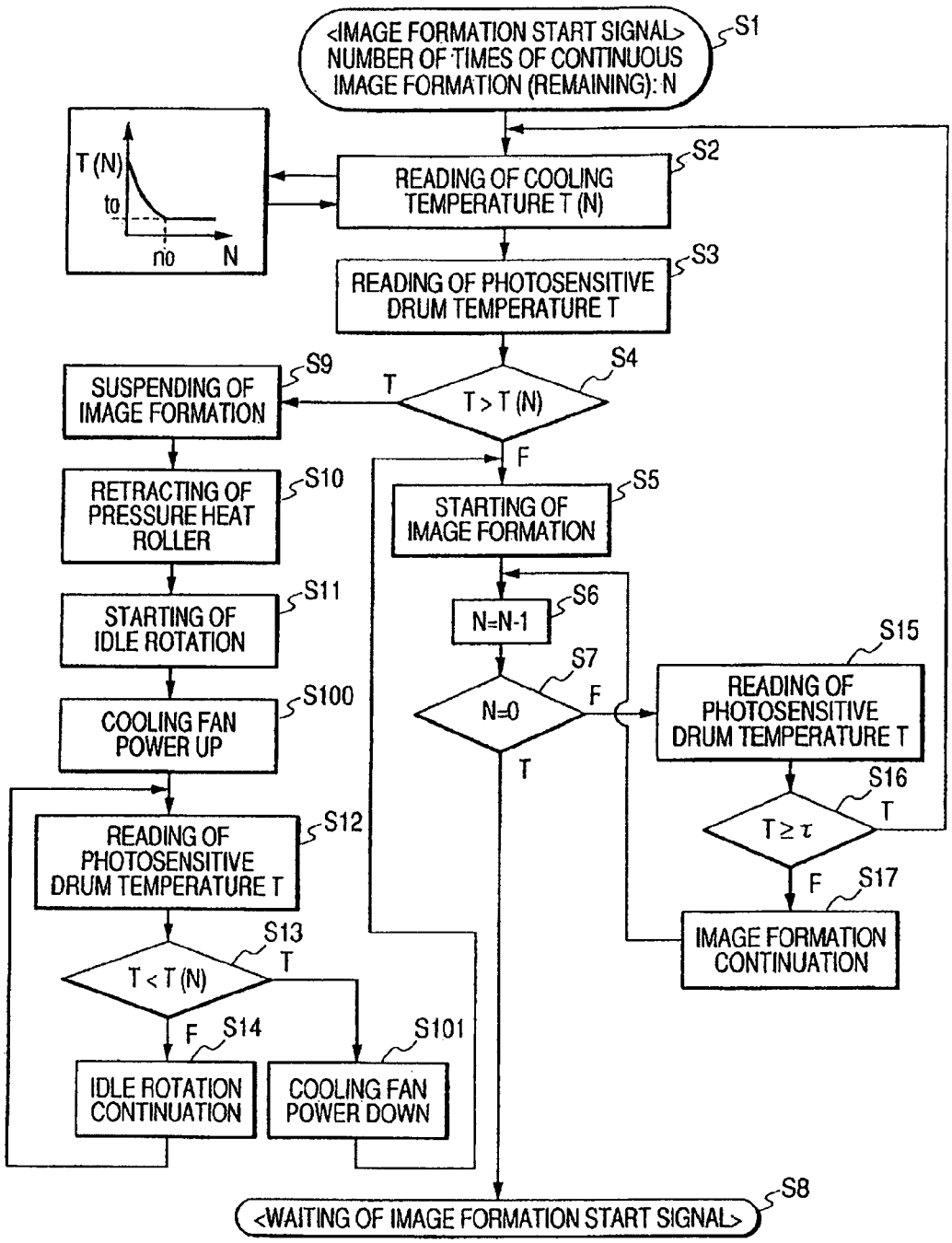
FIG. 7 is a flow diagram of control operation performed by the control circuit portion in the photosensitive drum cooling process configuration of a third embodiment.

FIG. 7 is a flow diagram of the control operation performed by the control circuit portion 30 in the photosensitive drum cooling process configuration of this embodiment. It is different from the flow diagram of the control operation of the second embodiment in FIG. 4 in that the control operation for "the cooling fan power up" is added as a step S100 between the step S11 and S12 of FIG. 4 and the control operation for "the cooling fan power down" is added as a step S101 between the step S13 and S5 thereof. Other control operations are the same.

To be more specific, this embodiment renders output of the cooling fan 23 in the idle rotation mode of the photosensitive drum 1 and the intermediate transferring belt 9 larger than that in the image formation mode so as to cool the intermediate transferring belt 9 by means of forced radiation and accelerate the cooling of the photosensitive drum 1. The idle rotation mode is continued unless the photosensitive drum temperature T becomes lower than the cooling temperature T(N). When the photosensitive drum temperature T becomes lower than the cooling temperature T(N), the image formation is started by powering down the cooling fan 23 to the output not disrupting the toner image on the intermediate transferring belt.

It is possible, by actively cooling the intermediate transferring belt 9 with the cooling fan 23, to alleviate the rise in the temperature of the photosensitive drum 1 and increase the number of times of continuous image formation until the cooling is required in the image formation mode and speed up a cooling rate of the photosensitive drum 1 in the idle rotation mode so as to eventually reduce the printing time for the user. To be more specific, it is possible to provide the image forming apparatus of improved productivity.

The cooling fan 23 is placed on the downstream side of the transfer fixing portion C2 and on the upstream side of the primary transfer portion C1 in the rotation direction of the intermediate transferring belt 9. It is thereby possible to cool the heat of the heated intermediate transferring belt 9 as much as possible before transmitting it to the photosensitive drum 1 so that the rise in the temperature of the photosensitive drum 1 can be alleviated and the number of times of continuous image formation until the cooling is required can be increased in the image formation mode and the cooling rate of the photosensitive drum 1 can be sped up in the idle rotation mode so as to eventually reduce the printing time for the user. To be more specific, it is possible to provide the image forming apparatus of improved productivity.

Fourth Embodiment

Figure 8:
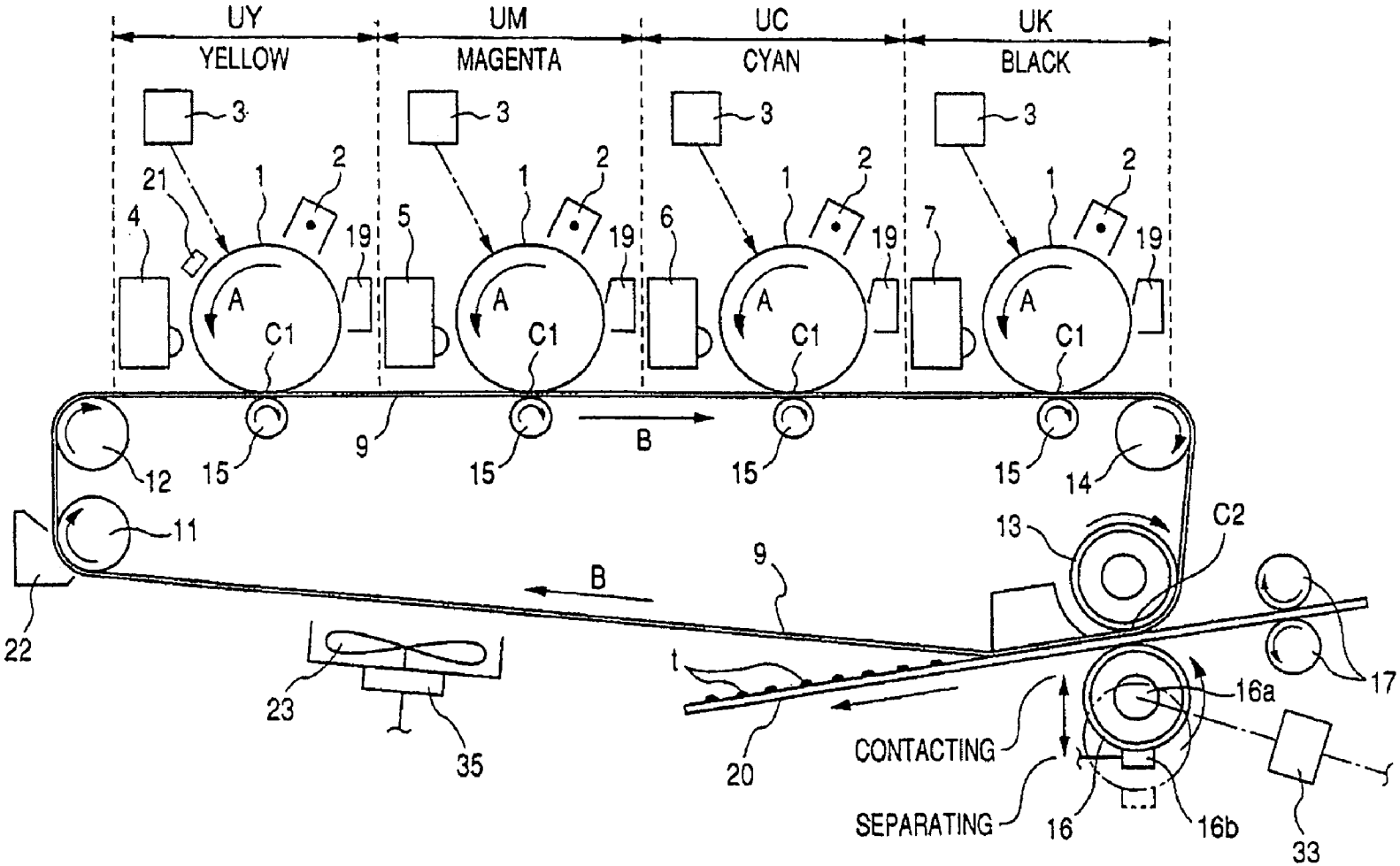
FIG. 8 is a general configuration model diagram of an image forming apparatus of a fourth embodiment.

FIG. 8 is a general configuration model diagram of the image forming apparatus of this embodiment. The image forming apparatus of this embodiment is a four-color full-color image forming apparatus having four image forming units arranged tandem along the moving direction of the intermediate transferring belt as the intermediate transferring member. It transfers and simultaneously fixes the toner image on the intermediate transferring belt to a secondary transfer portion.

This image forming apparatus comprises four of the first to fourth image forming units of UY (yellow), UM (magenta), UC (cyan) and UK (black) from left to right on the drawing. All these image forming units are comprised of the same electrophotographic image formation process mechanism including the following electrophotographic image formation process devices respectively.

a: A drum-shaped electrophotographic photosensitive member (photosensitive drum) 1 as the first image bearing member which is rotatively driven at the predetermined peripheral velocity in the counterclockwise direction as indicated by the arrow A by the driving means (unshown);

b: a primary charging apparatus 2 for uniformly charging the surface of the photosensitive drum 1 at the same polarity and potential;

c: exposure means 3 such as a laser scanner and an LED array for performing optical image exposure on a uniform charging surface of the photosensitive drum 1 and writing and forming the electrostatic latent image;

d: developing devices 4 to 7 for developing the electrostatic latent image formed on the photosensitive drum 1 as the toner image;

e: primary transfer rollers 15 as the primary transferring means for transferring the toner image to the intermediate transferring belt 9 as the second image bearing member by means of the primary transfer nip portion C1; and f: a cleaner 19 for cleaning the surface of the photosensitive drum 1 after transferring the toner image to the intermediate transferring belt 9.

The first image forming unit UY has a yellow toner as a developer stored in the developing device 4, and creates a yellow toner image on the photosensitive drum 1. The second image forming unit UM has a magenta toner as the developer stored in the developing device 5, and creates a magenta toner image on the photosensitive drum 1. The third image forming unit UC has a cyan toner as the developer stored in the developing device 6, and creates a cyan toner image on the photosensitive drum 1. The fourth image forming unit UK has a black toner as the developer stored in the developing device 7, and creates a black toner image on the photosensitive drum 1.

The intermediate transferring belt 9 is wound and looped around among the four loop-around rollers 11 to 14 by extending its upward belt portion on an undersurface of the photosensitive drum 1 of each image forming unit on downsides of the first to fourth image forming units UY, UM, UC and UK. The intermediate transferring belt 9 is rotatively driven with the loop-around roller 14 as the driving roller at approximately the same peripheral velocity as the photosensitive drum 1 in the clockwise direction as indicated by an arrow B.

Reference numeral 15 denotes four primary transfer rollers, which are placed on the backside (inner surface side) of the intermediate transferring belt 9 in the first to fourth image forming units UY, UM, UC and UK and have the primary transfer nip portion C1 formed between the photosensitive drum 1 and an upper side (outer surface side) of the intermediate transferring belt 9 by having it crimped on the undersurface of the corresponding photosensitive drum 1 via the upward belt portion (belt portion between the loop-around rollers 12 and 14) of the intermediate transferring belt 9.

Reference numeral 16 denotes the pressure heat roller comprising the transfer fixing means, which is arranged separably from the loop-around roller 13 by the rocking means 33 via the intermediate transferring belt 9 with the loop-around roller 13 out of the intermediate transferring belt loop-around rollers 11 to 14 as the backup roller for transfer fixing. The transfer fixing means is comprised of the heat roller 16 and the backup roller 13. The heat roller 16 is put in a crimped state against the backup roller 13 via the intermediate transferring belt 9 so that a transfer fixing portion (secondary fixing simultaneous with transfer nip portion) C2 is formed between the heat roller 16 and the intermediate transferring belt 9. The heat roller 16 is driven and rotated by rotation of the intermediate transferring belt 9. The heat roller 16 includes the heater 16*a* , where electric power is supplied to the heater 16*a* from the heater power supply 32 (FIG. 2) and the heater 16*a* generates heat so as to have the heat roller 16 internally heated. And the surface temperature of the heat roller 16 is detected by the temperature sensor 16*b* so that its electrically detected temperature information is inputted to the temperature control function portion 30*a* of the control circuit portion 30 (FIG. 2) as the control means. The temperature control function portion 30*a* controls supplied power from the heater power supply 32 to the heater 16*a* to keep the electrically detected temperature information inputted from the temperature sensor 16*b* corresponding to the predetermined approximately constant fixing temperature so as to control the heat roller 16 at the predetermined fixing temperature.

A full-color image forming operation is as follows. The first to fourth image forming units UY, UM, UC and UK are driven sequentially in accordance with timing of the image formation. The intermediate transferring belt 9 is also rotatively driven. The toner image of a yellow component of the full-color image is formed on the surface of the photosensitive drum 1 of the first image forming unit UY, the toner image of a magenta component of the full-color image is formed on the surface of the photosensitive drum 1 of the second image forming unit UM, the toner image of a cyan component of the full-color image is formed on the surface of the photosensitive drum 1 of the third image forming unit UC, and the toner image of a black component of the full-color image is formed on the surface of the photosensitive drum 1 of the fourth image forming unit UK in predetermined control timing respectively.

The yellow toner image, magenta toner image, cyan toner image and black toner image formed on the surfaces of the photosensitive drums 1 of the image forming units are sequentially superimposed and transferred in an aligned state on the surface of the intermediate transferring belt 9 in the primary transfer nip portions C1 of the image forming units so as to synthetically form an unfixed full-color toner image on the intermediate transferring belt 9.

The unfixed full-color toner image synthetically formed on the intermediate transferring belt 9 is conveyed to the transfer fixing portion C2 by the continuous rotation of the intermediate transferring belt 9.

The transfer material 20 supplied from the sheet feeding mechanism (unshown) is supplied to the transfer fixing portion C2 by the resist rollers 17 in predetermined timing, and the pressure heat roller 16 sandwiches the transfer material 20 against the backup roller 13. To be more specific, the transfer fixing portion C2 pressurizes the toner from the backside of the transfer material and the surface of the toner image with the backup roller 13 and the heated pressure heat roller 16. It thereby performs the melting transfer fixing process wherein the toner is plastically deformed, sintered and coalesced and seeps in the transfer material 20 to be cooled and firmly fixed immediately after the passage so as to simultaneously transfer and fix the toner image onto the transfer material 20. After passing the transfer fixing portion C2, the intermediate transferring belt 9 has its image bearing surface side cleaned by the belt cleaner 22.

The four-color full-color image forming apparatus having the image forming units arranged tandem thereon as described above can also obtain the same effects by applying the photosensitive drum cooling process configuration of the first embodiment. It is possible, for instance, to arrange the temperature sensor 21 for detecting the temperature of the photosensitive drum 1 of the first image forming unit UY (yellow) which is most upstream in the moving direction of the intermediate transferring belt or arrange the temperature sensor 21 for detecting the temperature of at least one photosensitive drum 1 of the first to fourth image forming units or provide the cooling fan 23 so as to apply the photosensitive drum cooling process configuration of the second embodiment or the third embodiment and obtain the same effects.

This application claims priority from Japanese Patent Application No. 2004-131237 filed on Apr. 27, 2004, which is hereby incorporated by reference herein.

What is claimed is:

1. An image forming apparatus comprising:

a rotatable image bearing member;

electrostatic image forming means capable of continuously forming electrostatic images on said image bearing member based on forming image amount information;

toner image forming means for developing the electrostatic image on said image bearing member and forming a toner image;

primary transferring means for transferring the toner image on said image bearing member to a rotatable intermediate transferring member;

simultaneously transferring and fixing means for simultaneously transferring the toner image on said intermediate transferring member to a recording material and heating and fixing the toner image to the recording material;

image bearing member detecting means for detecting a temperature of the image bearing member; and starting means for starting electrostatic image formation of said electrostatic image forming means based on a detection result of said image bearing member detecting means and the forming image amount information.

2. The image forming apparatus according to claim 1, wherein the temperature of the image bearing member becomes lower as the forming image amount becomes larger when said starting means starts the electrostatic image formation of said electrostatic image forming means.

3. The image forming apparatus according to claim 2, further comprising stopping means for stopping the electrostatic image formation of said electrostatic image forming means according to the detection result of said image bearing member detecting means.

4. The image forming apparatus according to claim 3, wherein said stopping means stops the electrostatic image formation of said electrostatic image forming means in a case where the temperature of said image bearing member detected by said image bearing member detecting means is a predetermined temperature or more.

5. The image forming apparatus according to claim 3 or 4, wherein said simultaneously transferring and fixing means includes a heating member for heating the toner image on said intermediate transferring member separable from the intermediate transferring member, and wherein said heating member separates from said intermediate transferring member and said image bearing member and said intermediate transferring member rotate during a time from stopping of the electrostatic image formation by said stopping means until a start of the electrostatic image formation by said starting means.

6. The image forming apparatus according to claim 5, further comprising cooling means for cooling said intermediate transferring member, wherein said cooling means cools said intermediate transferring member during the time from the stopping of the electrostatic image formation by said stopping means until the start of the electrostatic image formation by said starting means.

* * * * *

UNITED STATES PATENT AND TRADEMARK OFFICE

CERTIFICATE OF CORRECTION

PATENT NO. : 7,315,702 B2
APPLICATION NO. : 11/113245
DATED : January 1, 2008
INVENTOR(S) : Hiroki Takayanagi It is certified that error appears in the above-identified patent and that said Letters Patent is hereby corrected as shown below:

COLUMN 4:

Line 4, “back-” should read --back--.

COLUMN 5:

Line 34, “-electrostatic” should read --electrostatic--.
Line 55, “primarily” should read --primary--.

COLUMN 6:

Lines 41 through 44, “above, that is, a harmful effect of the photosensitive drum 1 as the image bearing member due to a temperature rise exceeding allowance of the photosensitive drum 1 in conjunction with progress of continuous image formation.”
should read
--above. The aforementioned problem is a harmful effect which occurs due to an unallowable temperature rise of the photosensitive drum in accordance with continuous image formation.--.

COLUMN 7:

Line 9, “a” should read --an--.

COLUMN 10:

Line 1, “Formation of the desired electrostatic latent image.” should be deleted.
Line 42, “temperature T” should read --temperature $\tau$--.
Line 53, “(steps S).” should read --(step S).--.
Line 54, “(steps” should read --(step--.

UNITED STATES PATENT AND TRADEMARK OFFICE

CERTIFICATE OF CORRECTION

PATENT NO. : 7,315,702 B2
APPLICATION NO. : 11/113245
DATED : January 1, 2008
INVENTOR(S) : Hiroki Takayanagi It is certified that error appears in the above-identified patent and that said Letters Patent is hereby corrected as shown below:

COLUMN 11:

Line 11, "rise limit temperature X" should read --rise limit temperature τ--.
Line 22, "(steps S8)." should read --(step S8).--.

COLUMN 14:

Line 21, "timing" should read --timing,--.
Line 40, "backside" should read --back side--.

Signed and Sealed this

Nineteenth Day of August, 2008

JON W. DUDAS
*Director of the United States Patent and Trademark Office*